US006314931B1

(12) United States Patent
Yasuda et al.

(10) Patent No.: US 6,314,931 B1
(45) Date of Patent: Nov. 13, 2001

(54) STRUCTURE OF SNORKEL DUCT FOR ROUGH GROUND RUNNING VEHICLE

(75) Inventors: Kazuhiro Yasuda; Masasi Koyanagi; Yuichiro Tsuruta, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/655,340

(22) Filed: Sep. 5, 2000

(30) Foreign Application Priority Data

Sep. 5, 1999 (JP) ..... 11-291423

(51) Int. Cl.[7] ..... F02M 35/10
(52) U.S. Cl. ..... 123/184.53; 181/229
(58) Field of Search ..... 123/184.53; 181/229

(56) References Cited

U.S. PATENT DOCUMENTS 5,424,494 * 6/1995 Houle et al. ..... 181/229

FOREIGN PATENT DOCUMENTS 4-132869 * 5/1992 (JP) .
9-256922 * 9/1997 (JP) .
A2873938 1/1999 (JP) .

* cited by examiner

*Primary Examiner*—Noah P. Kamen
(74) *Attorney, Agent, or Firm*—Birch, Stewart, Kolasch & Birch, LLP

(57) ABSTRACT

A snorkel duct including a main body portion extended forwardly from an air cleaner in an oblique upper direction with a substantially uniform cross sectional area and a bent portion bending at a front end portion thereof. An air inlet is provided at a front end of the bent portion and is opened at a position where water, dust or the like is difficult to invade. A main opening portion opened in a lower direction is provided at a portion of the main body portion at a vicinity of the bent portion and a smaller drain hole is opened on a lower side thereof An expansion chamber is attached to a side of the main body portion in order to cover the main opening portion and the drain hole, and the cross sectional area of the main body portion is rapidly enlarged at the main opening portion to thereby reduce air-flow resistance, prevent pulsation sounds from being generated, and to silence intake noise.

18 Claims, 7 Drawing Sheets

STRUCTURE OF SNORKEL DUCT FOR ROUGH GROUND RUNNING VEHICLE

BACKGROUND OF THE INVENTION

1. Field of the Invention

The present invention relates to the structure of a snorkel duct preferably for use in an all terrain vehicle, such as a four-wheel buggy vehicle.

2. Background Art

A snorkel duct in all terrain type vehicles needs to open at a position at which water, mud, snow, dust or the like is unlikely to invade the air intake system of the vehicle. Accordingly, it would appear obvious to increase the length of air intake pipe to a distance that would prevent ingestion of solid or liquid contaminates. However, air flow resistance is consequently increased as the length of the intake pipe is increased. An example of a vehicle having such a long snorkel duct is disclosed in Japanese Patent No. 2873938.

In the conventional intake system of described above, a plate-like flange is formed at a position deviating from an intermediate portion of the intake duct in order to effectively reduce the intake passage by as much as forty to seventy percent. This arrangement is utilized in order to maintain a proper air-fuel ratio independently of engine speed.

However, increasing the cross sectional area of the intake opening in this arrangement by widening the snorkel duct in order to reduce the air-flow resistance is liable to deteriorated any silencing effects of intake noise. This type of arrangement will also limit the potential layout of the intake system of any vehicle for which it is employed, thereby reducing frame design and the positioning of components. Further, when the length of the intake pipe is substantially increased as in the conventional art, undesirable noises are caused by pulsations of air flow through the snorkel duct and intake pipe.

SUMMARY OF THE INVENTION

The present invention overcomes the shortcomings associated with the prior art and achieves other advantages not realized by the prior art.

It is an object of the present invention to provide a snorkel duct structure that can be utilized in a variety of vehicle designs and arrangements.

It is an object of the present invention to provide a snorkel duct structure that can be long enough to prevent ingestion of solid and liquid contaminants along with outside air while still reducing noise.

It is an object of the present invention to provide a snorkel duct structure that reduces maintenance procedures and requirements.

It is a further object of the present invention to provide a rapid increase in the inlet cross sectional area of the snorkel duct structure while also reducing air-flow resistance, prevent pulsation sounds from being generated, and silencing intake noise.

Accordingly, these and other objects are accomplished by a snorkel duct for an all terrain vehicle comprising a main body portion extending from an air cleaner for the all terrain vehicle; a bent portion formed on a front end side of the snorkel duct and which opens as an inlet for introducing outside air to the air cleaner; an expansion chamber provided at a side face of the main body portion in a vicinity of the bent portion; and a main opening portion formed at the side face of the main body portion, wherein the expansion chamber and an inner portion of the main body portion are in communication with each other via the main opening portion.

These and other objects are further accomplished by a snorkel duct for preventing ingestion of water and contaminants into an air cleaner of an all-terrain vehicle, the snorkel duct comprising a main body portion having an upper end portion and a connecting portion; a bent portion formed on a front end side of the snorkel duct and which opens as an inlet for introducing outside air to the air cleaner; an expansion chamber attached at a lower side face of the main body portion between the bent portion and an upper end portion of the main body portion; a main opening portion formed at the lower side face of the main body portion, wherein the expansion chamber and an inner portion of the main body portion are in communication with each other via the main opening portion; and a drain hole formed at the lower side face of the main body portion between the connecting end and the main opening portion for draining water from the expansion tank to the air cleaner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 2:
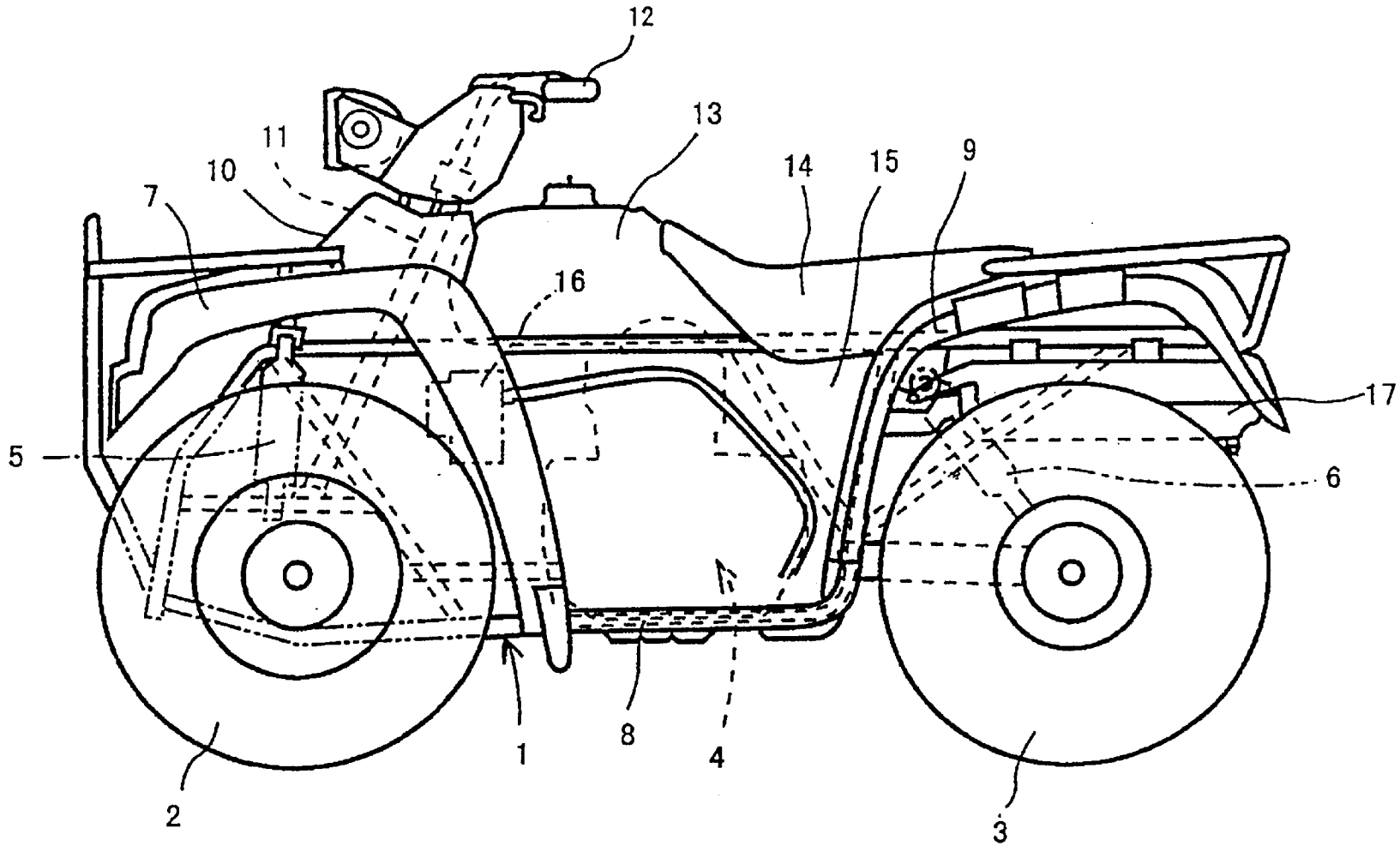
FIG. 2 is a side view of a four-wheeled buggy to which an embodiment of the present invention is applied.
Figure 3:
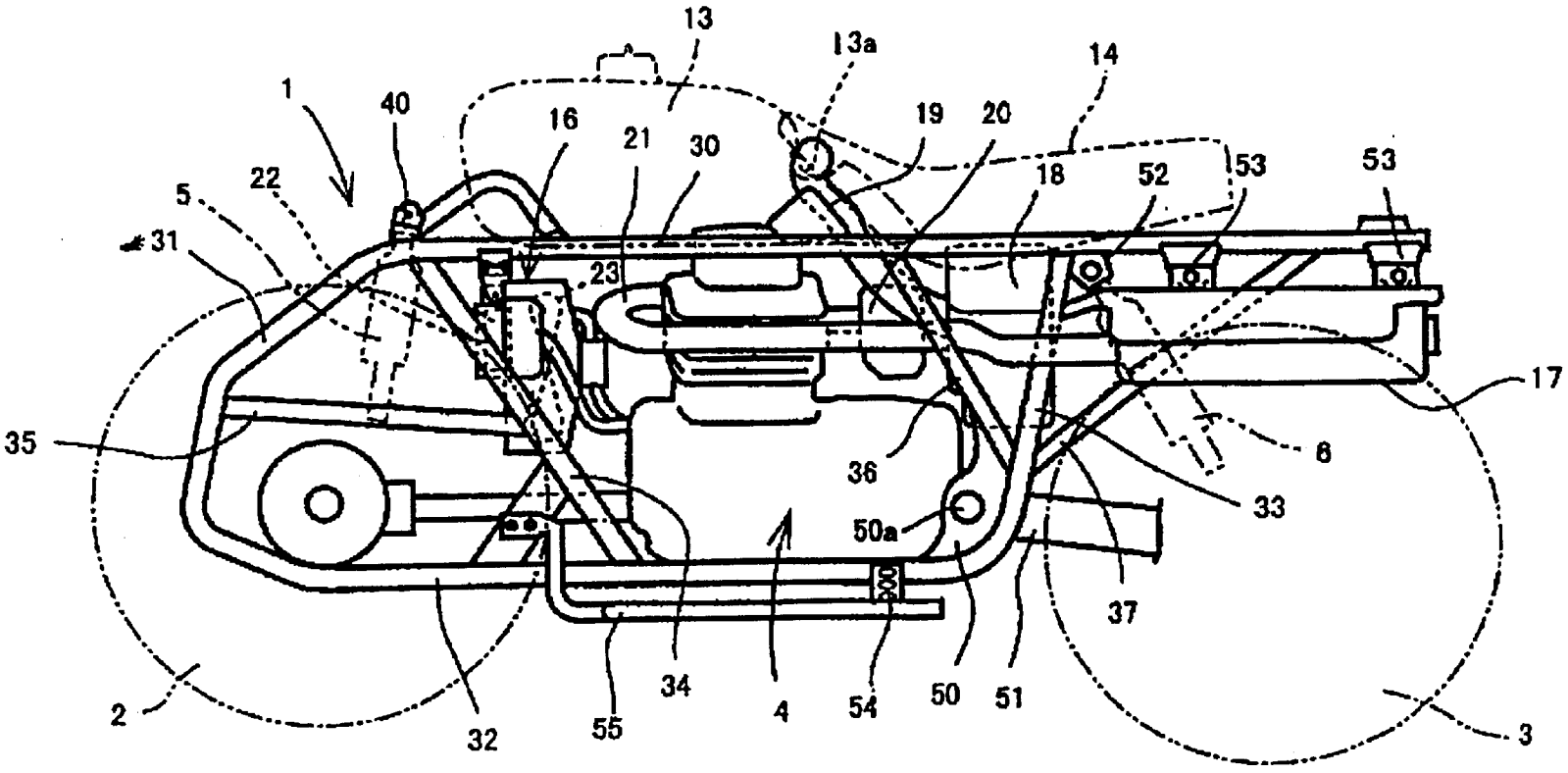
FIG. 3 is a side view showing portions of a four-wheeled vehicle body to which an embodiment of the present invention is applied.
Figure 4:
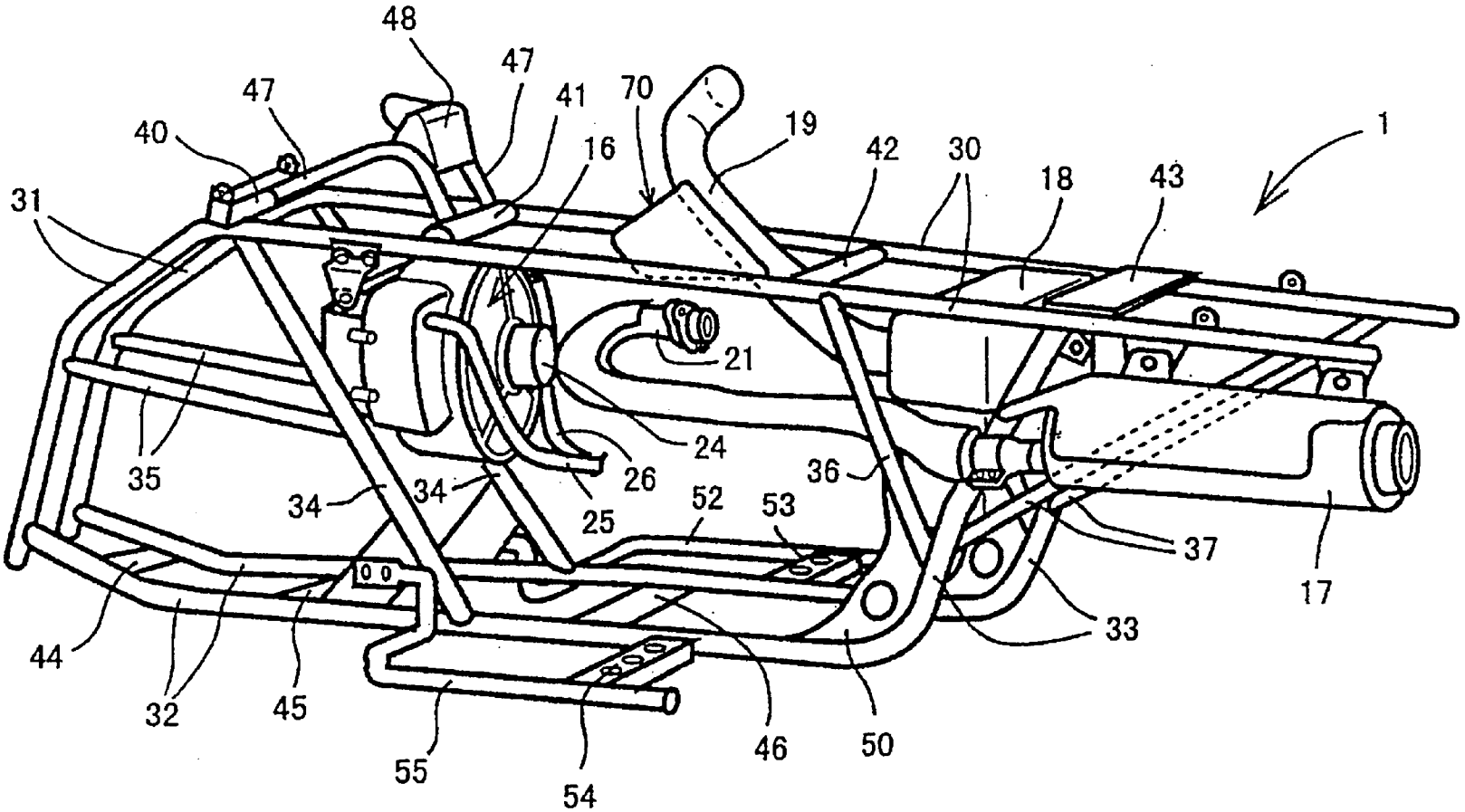
FIG. 4 is an enlarged perspective view showing a portion of the four-wheeled vehicle body according to an embodiment of the present invention.

An explanation will be given of an embodiment applied to a four-wheel buggy vehicle in reference to the drawings as follows. First, an explanation will be given of an outline of a general vehicle body with reference to the following figures. FIG. 2 is a side view of a four-wheeled buggy to which an embodiment of the present invention is applied. FIG. 3 is a side view showing portions of a four-wheeled vehicle body to which an embodiment of the present invention is applied. FIG. 4 is an enlarged perspective view showing a portion of the four-wheeled vehicle body according to an embodiment of the present invention.

The four-wheeled buggy vehicle includes pairs of front wheels 2 and rear wheels 3 comprising low pressure balloon tires that are respectively supported on a left and a right side of a front and a rear portion of a vehicle body frame 1. The vehicle is driven by a power unit 4 mounted at a central portion of the vehicle body frame 1. A front cushion 5 and a rear cushion are provided for suspension of the vehicle.

As seen in FIG. 2, a front fender 7, a sub fender 8, and a rear fender 9 surround their respective wheels. The vehicle also includes a front panel 10, a steering shaft 11, a handlebar 12, a fuel tank 13, a saddle riding type seat 14, a rear panel 15, a cooling unit 16 and a muffler 17. FIG. 3 shows an air cleaner 18, a snorkel duct 19, and a carburetor 20 according to an embodiment of the present invention.

Next, an explanation of the structure of the vehicle body frame 1 will be provided with reference to the drawings. As shown by FIG. 3 and FIG. 4, the vehicle frame 1 is provided with respective left and right pairs of upper pipes 30 extended in a front and rear direction substantially in parallel with each other and in a linear shape. Front pipes 31 extend in a vertically downward direction from front end portions thereof, lower pipes 32 extend in a rearward direction from lower end portions thereof, and center pipes 33 extend in an extend vertically upward from rear end portions thereof The center pipes 33 are connected to positions shifted rearward from middle portions of the upper pipe 30.

The vehicle body frame 1 is also provided with respective left and right pairs of reinforcement pipes 34 connected from front end portions of the upper pipe 30 to front half side portions of the lower pipe 32 in an oblique direction. The frame 1 has middle pipes 35 connecting respective middle portions of the reinforcement pipes 34 with the front pipes 31 in the front and rear direction. Reinforcement pipes 36 and 37 are provided for connecting middle portions of the center pipes 33 with front and rear positions of the upper pipes 30. The center pipes 33 are thereby connected with the upper pipes 30. A cross member 40, cross pipes 41 and 42, and cross members 43, 44, 45, 46 are respectively made to span and integrally connect the aforementioned members defining the left and right sides of the vehicle body frame 1.

The cross member 40 is provided between front end portions of the upper pipes 30 and is connected with the cross pipe 41. The cross pipe 41 is arranged on a rear side of the front end portions of the upper pipes and in parallel with the cross member 40. Head portion pipes 47 are formed in a shape of a mountain when viewed from the side as it extends upwardly and back downward as it spans the front to the rear of the vehicle frame. An upper portion of the steering shaft 11 is rotatably supported by a stay 48 provided at top portions of the head portion pipes 47. A lower end portion of the steering shaft 11 is axially supported at a bearing portion provided at the middle pipes 35.

Further, an upper end portion of the front cushion 5 is supported by both left and right ends of the cross member 40 and a lower end portion of the front cushion 5 is attached to upper arms constituting a front wheel suspension of a double wishbone type (not illustrated). The upper arms are pivotably supported by the middle pipes 35 and lower arms paired therewith are pivotably supported by front end portions of the lower pipes 32.

Pivot plates 50 are provided at corner portions of lower portions of the center pipes 33 and rear ends of the lower pipes 32 and front end portions of rear swing arms 51 are pivotably supported thereby. The rear swing arm 51 contains a drive shaft constituting a rear wheel drive mechanism.

The upper pipes 30 are extended further rearward from portions thereof connecting with the center pipes 33 and an upper end portion of the rear cushion 6 is supported by stays 52 provided at the upper end portions and the muffler 17 is supported by another stay 53 at the most rearward portion of the upper pipes 30.

As seen in FIG. 3 and FIG. 4, a rear end portion of an exhaust pipe 21 is connected to the muffler 17. The exhaust pipe 21 extends in the front direction (with respect to the vehicle frame) in a substantially linear shape and a front end portion thereof is bent substantially in a U-like shape and is connected to an exhaust port provided at a cylinder head of the power unit 4. The cooling unit 16 is hung from and supported by the upper pipes 30 on a front side of the power unit 4. The cooling unit 16 includes at least an oil cooler 22, a cooling fan 23, a cooling fan motor 24, and various hoses 25 and 26 connected to the power unit 4.

Steps 54 extending to outer sides of the frame 1 are provided at portions of the left and right lower pipes 32 for mounting the power unit 4. The steps 54 protrude from the lower pipes 32 in directions away from the frame centerline and step frames 55 are bent to connect front ends of the step frames with the lower pipes 32. As seen in FIG. 2, the sub fender 8 is mounted on and attached to these members (the sub fender 8 on the right side of the vehicle body is not illustrated).

Figure 1:
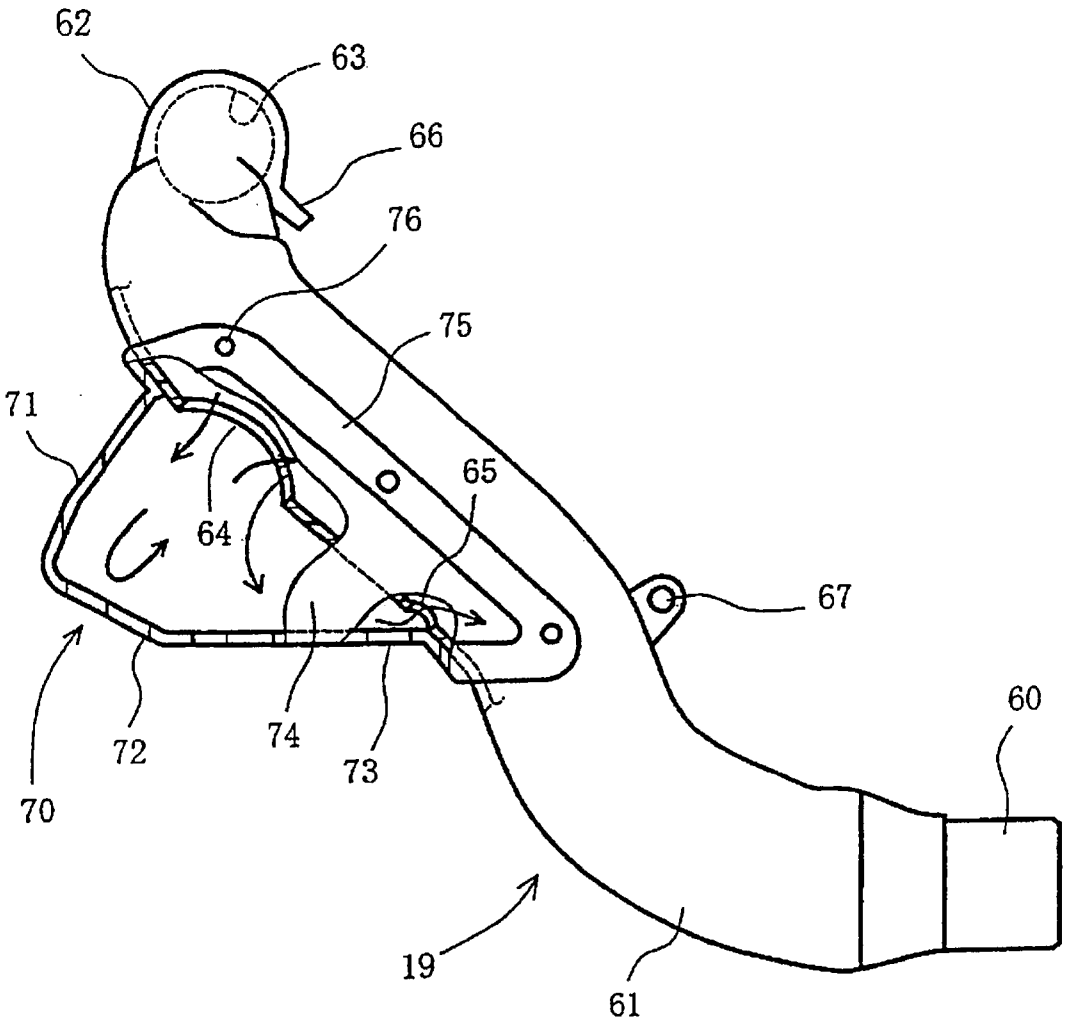
FIG. 1 is a partially cut-away side view showing a snorkel duct according to an embodiment of the present invention.
Figure 5:
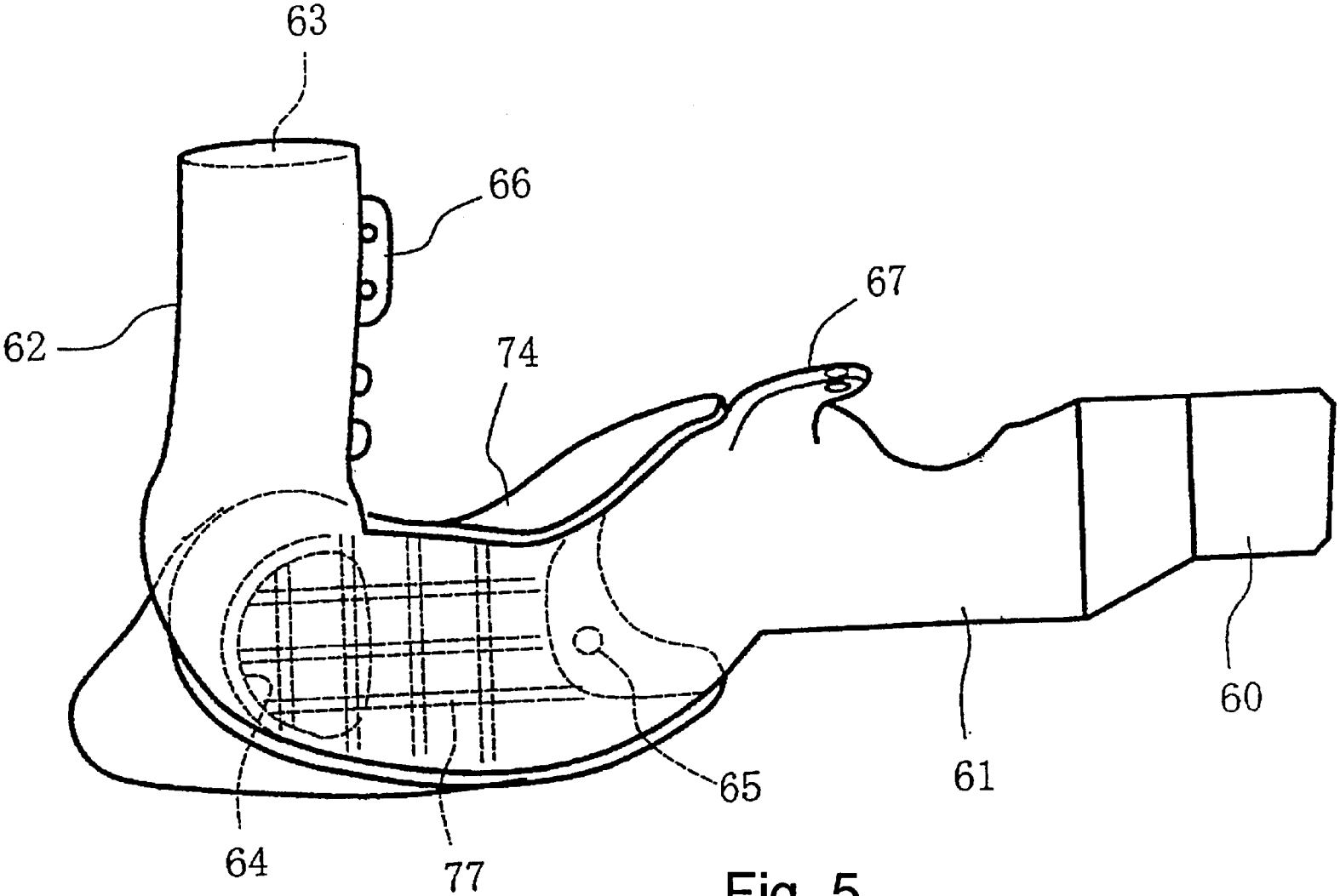
FIG. 5 is a plane view of a snorkel duct according to an embodiment of the present invention.
Figure 6:
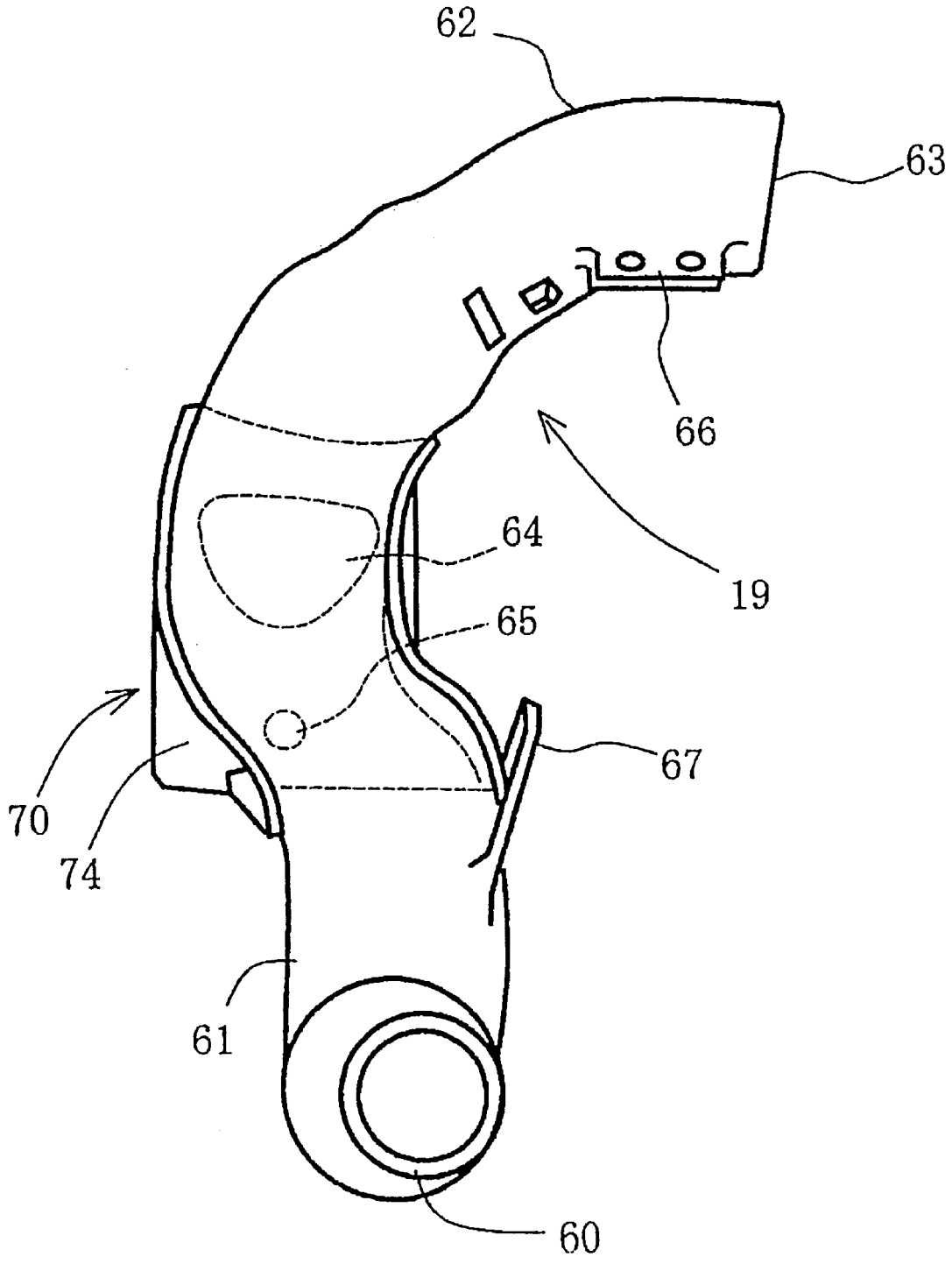
FIG. 6 is a rear view of a snorkel duct according to an embodiment of the present invention.
Figure 7:
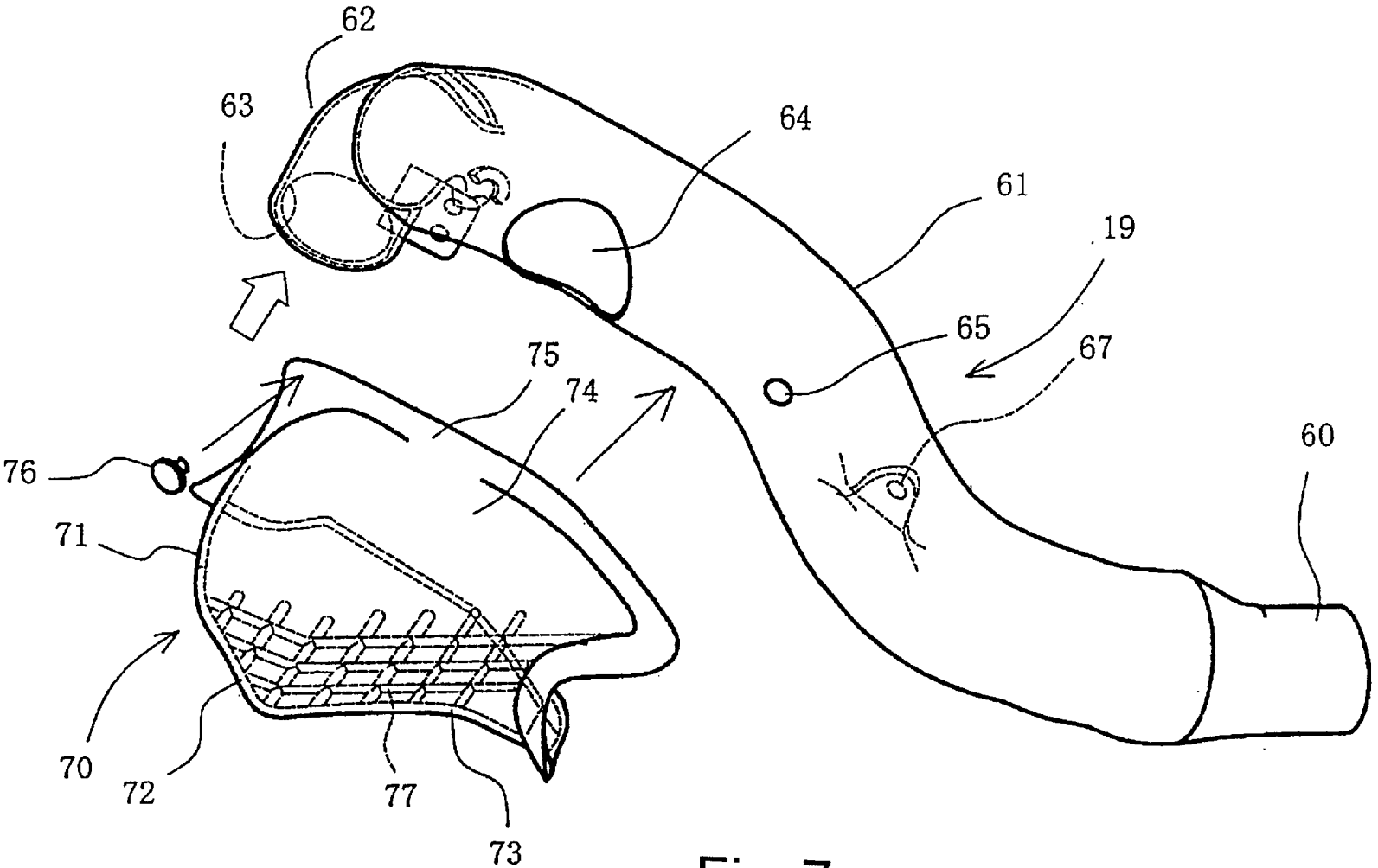
FIG. 7 is an exploded view of a snorkel duct according to an embodiment of the present invention representing assembly of the present invention.

Next, the structure of the snorkel duct 19 will be described with respect to the accompanying drawings. FIG. 1 is a partially cut-away side view showing a snorkel duct according to an embodiment of the present invention. FIG. 5 is a plane view of a snorkel duct according to an embodiment of the present invention. FIG. 6 is a rear view of a snorkel duct according to an embodiment of the present invention. FIG.7 is an exploded view of a snorkel duct according to an embodiment of the present invention representing assembly of the present invention.

As shown in the aforementioned drawings, the snorkel duct 19 includes an intake pipe. One end of the intake pipe constitutes a connecting end 60 for connecting to the air cleaner 18. A main body portion 61 extends in the forward direction from the connecting end 60 in an oblique upper direction, and a bent portion 62 bends from a front end portion to the right side of the vehicle.

The bent portion 62 is contained on a recess portion 13*a* (FIG. 3) and a front end thereof constitutes an inlet 63 opened to be directed to the right side of the vehicle body. Further, as shown by FIG. 2, the bent portion 62 is covered by a front end portion of the seat 14 and the inlet 63 is opened at a position at which water, dust or other contaminants are likely going to be difficult to enter the inlet 63.

The main body portion 61 is a pipeline portion having a substantially constant cross sectional area and relatively small curved portions. A main opening portion 64 is provided at a lower side of the main body portion 61 for communicating with an expansion chamber 70. The main opening portion is provided at an upper end side of the main body portion 61 near the bent portion 62. The main opening portion 64 communicates with the expansion chamber 70 in order to permit the expansion of a portion of the air flow flowing from the bent portion 62 into the main body portion 61. A rapid increase in the cross sectional area of the main body portion 61 is achieved by utilizing this arrangement of the main opening portion 64 and the expansion chamber 70.

The opening area of the main opening portion 64 is set such that the opening area is equal to the cross sectional area of the main body portion 61 multiplied by an integer in a preferred embodiment. Furthermore, a drain hole 65 is provided for communicating the main body portion 61 with the expansion chamber 70 by an opening area smaller than that of the main opening portion 64 on a lower side of the main opening portion 64. Therefore the opening area of the main opening portion 64 is considerably larger than that of the drain hole 65 in order to simply pass water that has invaded into the snorkel duct 19 and the expansion chamber 70 toward the side of the main body portion 61. According to one embodiment of the present invention, the opening area of the main opening portion 64 is set to about 8 through 9 times as large as that of the drain hole 65.

A stay 66 is integrally provided to the bent portion 62 and a second stay 67 is similarly integrally provided to the main body portion 61. These stays are provided in order to attach the snorkel duct 19 to the vehicle body side. The expansion chamber 70 is provided from the lower side of the main body portion 61 in order to cover and enclose the main opening portion 64 and the drain hole 65. The expansion chamber 70 is a hollow member formed substantially in a trapezoidal shape in a side view of a preferred embodiment. The expansion chamber 70 is further provided with a front wall 71, a bottom wall 72, a rear wall 73, and left and right side walls 74. Further, the chamber 70 is opened on a top portion side and formed with an attaching flange 75 so that it effectively surrounds the opening portion. The chamber 70 is attached to a side face of the main body portion 61 in one embodiment by screws 76.

The bottom wall 72 is disposed to face the main opening portion 64 and is shaped to reflect air flow flowing against the snorkel 19 from the main body portion 64 back to a side of the main opening portion 64. Further, the front wall 71, the rear wall 73 and the left and right side walls 74 function similarly and constitute inclined faces respectively converging toward the bottom wall 72 for the same purpose.

As shown in FIG. 1, the rear wall 73 becomes substantially horizontal in a portion where the expansion chamber 70 is attached. The drain hole 65 is disposed in the same vicinity of a rear end portion thereof This arrangement ensures that water stored on the rear wall 73 flows from the drain hole 65 and into the main body portion 61 as shown by a flow arrow in FIG. 1. An inner face of the expansion chamber 70 is integrally formed with at least one rib 77 in a lattice shape for reinforcing an expansion chamber 70 having a comparatively large capacity.

Next, one method of operation of one of the preferred embodiments of the present invention will be provided with reference to the accompanying drawings. The cross sectional area of the snorkel duct 19 is rapidly and considerably increased by the formation of the main opening portion 64 and expansion chamber 70. Therefore, as shown by FIG. 1, air flow flowing from the inlet 63 into the bent portion 62, enters the main body portion 61 and a portion thereof flows from the main opening portion 64 into the expansion chamber 70. Air diverted into the expansion chamber 70 is reflected by the respective wall faces starting from the bottom wall 72 and returns again from the main opening portion 64 into the main body portion 61 and enters the air cleaner 18 from a connecting end 60.

Therefore, even when the length of the intake pipe of the snorkel duct 19 as a whole is increased, the air-flow resistance is reduced by a partial increase in the cross sectional area in the vicinity of the main opening portion 64 and the expansion chamber 70. As a result, there is no need to thicken or widen the total area of the snorkel duct 19 as might be necessary with devices of the conventional art. As a result, the snorkel duct can be effectively lengthened and the inlet 63 can be arranged without the undesirable effects of the conventional art. The inlet 63 can be positioned to bend freely to open at an optimum position at which water, dust or other undesirable contamination can be avoided, whereby vehicle body layout considerations are not limited, and the degree of freedom of design considerations is enhanced.

Further, the main body portion 61 having the substantially uniform cross sectional area is defined to be between the main opening portion 64 and the connecting end 60. The cross sectional area can remain constant regardless of whatever length of the snorkel duct 19 the designer employs and is this section is comparatively short relative to the entire length of the snorkel duct 19. Therefore, the generation of sound pulsations can be prevented which would normally be encountered with an intake pipe having a substantially uniform cross sectional area in the conventional art. Further, intake noise transmitted from inside of the air cleaner 18 to the main body portion 61 is silenced since the expansion chamber 60 simultaneously functions as a resonator. Whereas silencing or muffling of inlet noise was deteriorated in the devices of the conventional art, the present invention ensures that the silencing effect of the snorkel duct is actually promoted.

Further, even if water were assumed to enter the bent portion 62 from the inlet 63, as shown by the dotted line, the water is stored in the expansion chamber 70. The water entrapped within the expansion chamber finally returns from the drain hole 65 to the main body portion 61. Thereafter, the water enters an inside portion of the air cleaner 18 and is stored at a bottom portion thereof Therefore, there is no need for carrying out maintenance or draining of the expansion chamber 70 that may be positioned in a portion of the vehicle frame that is difficult to reach by maintenance personnel. Instead, the effects of water infiltration, if any, can be carried out at a time when routine maintenance on the side of the air cleaner 18 is normally performed. Accordingly, efficient maintenance scheduling and performance can be achieved by the present invention.

Further, the present invention is not limited to the above-described embodiment but can be modified variously, for example, a vehicle constituting an object of application is not limited to a four wheel buggy wheel but is applicable to other various rough ground running vehicle. For instance, the snorkel may be provided on other off-road or all terrain type vehicles that may encounter extreme operating conditions during vehicle operation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A snorkel duct for an all terrain vehicle comprising:

a main body portion extending from an air cleaner for the all terrain vehicle, said main body portion including a drain hole;

a bent portion formed on a front end side of the snorkel duct, said bent portion opening as an inlet for introducing outside air to the air cleaner;

an expansion chamber provided at a side face of the main body portion in a vicinity of the bent portion;

and a main opening portion formed at the side face of the main body portion, wherein the expansion chamber and an inner portion of the main body portion are in communication with each other via the main opening portion, and the inner portion of the expansion chamber further communicates with the main body portion through the drain hole.

2. The snorkel duct according to claim 1, wherein the main body portion comprises a substantially uniform cross sectional area.

3. The snorkel duct according to claim 1, wherein the drain hole has a cross sectional area smaller than a cross sectional area of the main opening portion, and the drain hole is formed at a position on a lower side of the main body portion and the main opening portion is formed at an upper side of the main body portion.

4. The snorkel duct according to claim 3, wherein the area of the main opening portion is 8 to 9 times larger than the area of the drain hole.

5. The snorkel duct according to claim 3, wherein water and contaminants entering the snorkel duct with said outside air are entrained in said expansion chamber and drain back to the main body portion via the drain opening.

6. The snorkel duct according to claim 1, wherein the expansion chamber is formed so that air entering the expansion chamber via the main opening portion is reflected off of an inside surface of said chamber and then said air returns to the main body portion via the main opening portion.

7. The snorkel duct according to claim 1, wherein at least one stay is provided to attach the snorkel duct to a frame of the vehicle.

8. The snorkel duct according to claim 1, wherein the expansion chamber is a hollow member formed substantially in a trapezoidal shape.

9. The snorkel duct according to claim 8, wherein the expansion chamber includes a front wall, a bottom wall, a rear wall, a left side wall, a top portion and a right side wall, wherein the top portion of the expansion chamber encloses the main opening portion.

10. The snorkel duct according to claim 9, wherein the bottom wall is formed to face the main opening portion and is shaped to reflect air flowing against the snorkel from the main body portion back to the main body portion via the main opening portion.

11. The snorkel duct according to claim 10, wherein the expansion chamber is formed with an attaching flange in order to effectively surround the main opening portion.

12. The snorkel duct according to claim 11, wherein the expansion chamber is attached to a side face of the main body portion by screws.

13. The snorkel duct according to claim 9, wherein the rear wall is substantially horizontal in a portion where the expansion chamber is attached to the main body portion and the drain hole is formed where a rear end portion of the rear wall engages the main body portion.

14. The snorkel duct according to claim 13, wherein an inner face of the expansion chamber is integrally formed with at least one rib in a lattice shape for structural reinforcement.

15. A snorkel duct for preventing ingestion of water and contaminants into an air cleaner of an all-terrain vehicle, the snorkel duct comprising:

a main body portion having an upper end portion and a connecting portion;

a bent portion formed on a front end side of the snorkel duct and which opens as an inlet for introducing outside air to the air cleaner;

an expansion chamber attached at a lower side face of the main body portion between the bent portion and an upper end portion of the main body portion;

a main opening portion formed at the lower side face of the main body portion, wherein the expansion chamber and an inner portion of the main body portion are in communication with each other via the main opening portion; and a drain hole formed at the lower side face of the main body portion between the connecting end and the main opening portion for draining water from the expansion tank to the air cleaner.

16. A snorkel duct for an all terrain vehicle having a front portion, a rear portion, an upper portion and a lower portion with respect to a longitudinal axis of said vehicle, said snorkel duct comprising:

a main body portion having an upper end and a lower end, said lower end of said main body portion extending from an air cleaner for the all terrain vehicle;

a bent portion formed on a front end side of the snorkel duct and which opens as an inlet for introducing outside air to the air cleaner;

a main opening portion formed at the side face of the main body portion; and an expansion chamber provided at a side face of the main body portion in a vicinity of the bent portion, the expansion chamber further including a front wall, a bottom wall, a rear wall, a left side wall, a top portion, and a right side wall, said top portion of the expansion chamber enclosing the main opening portion, and wherein the expansion chamber and an inner portion of the main body portion are in communication with each other via the main opening portion.

17. The snorkel duct according to claim 16, wherein the bottom wall is formed to face the main opening portion and is shaped to reflect air flowing into the expansion chamber from the main opening portion back to the main body portion via the main opening portion.

18. The snorkel duct according to claim 16, wherein the expansion chamber is formed so that air containing airborne contaminants entering the expansion chamber via the main opening portion is reflected off of an inside surface of said chamber and then said air returns to the main body portion via the main opening portion and said contaminants collect along said bottom wall of said expansion chamber.

* * * * *